United States Patent [19]

Bernard

[11] Patent Number: 4,601,500

[45] Date of Patent: Jul. 22, 1986

[54] RELEASABLE COUPLING FOR ELECTRICAL VEHICLE-LATCH MECHANISM

[75] Inventor: Vincent Bernard, Anould, France

[73] Assignee: Compagnie Industrielle de Mecanismes en abrege C.I.M., France

[21] Appl. No.: 702,559

[22] Filed: Feb. 15, 1985

[30] Foreign Application Priority Data

Feb. 17, 1984 [FR] France ..... 84 02444

[51] Int. Cl.[4] ..... E05C 3/26

[52] U.S. Cl. ..... 292/201; 292/336.3

[58] Field of Search ..... 292/144, 201, 336.3

[56] References Cited

U.S. PATENT DOCUMENTS 4,364,249 12/1982 Kleefeldt ..... 292/201

*Primary Examiner*—Richard E. Moore

[57] ABSTRACT

A coupling engaging and releasing device, in particular for an electric latch locking mechanism for a motor vehicle door, said device comprising a driving element (8) movably mounted on a support (9) and a receiving element (4) to which coupling means (7) are attached, which coupling means are capable of being driven from a locking position to an unlocking position and vice versa, the coupling engaging means comprising two resilient strips (6) each provided with at least one wedge (7) which are symmetrical relative to a plane (P) intersecting the axis of displacement (X—X) of the driving element (8) and passing through the latter, and each wedge (7) having a planar surface (*7b*) which is parallel to said plane (P) and faces the latter, and an inclined ramp (*7a*), these strips (6) being disposed in such manner as to be capable of being coupled to the driving element (8) by one of their planar surfaces (*7b*) so as to drive the receiving element (4) from the locking position to the unlocking position or vice versa by resiliently moving away from the driving element (8) so as to assume an uncoupled position in either of said two locking and unlocking positions.

18 Claims, 12 Drawing Figures

FIG.1
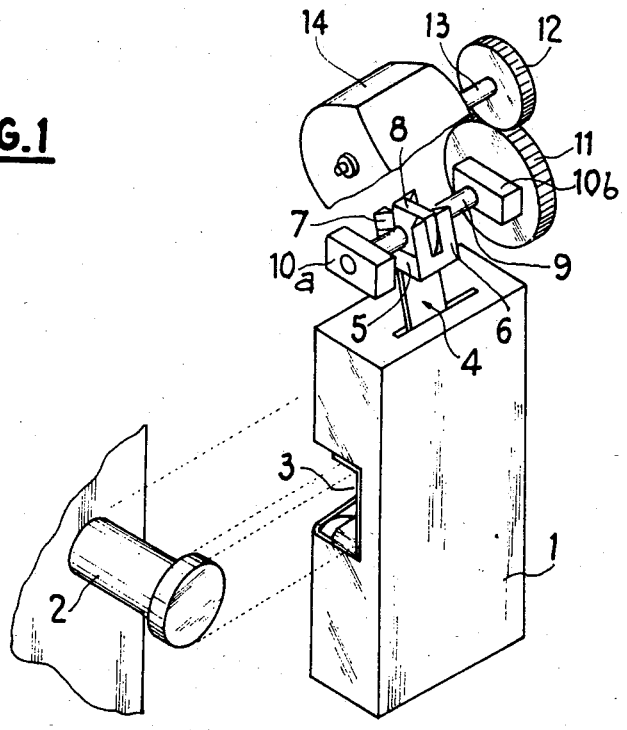
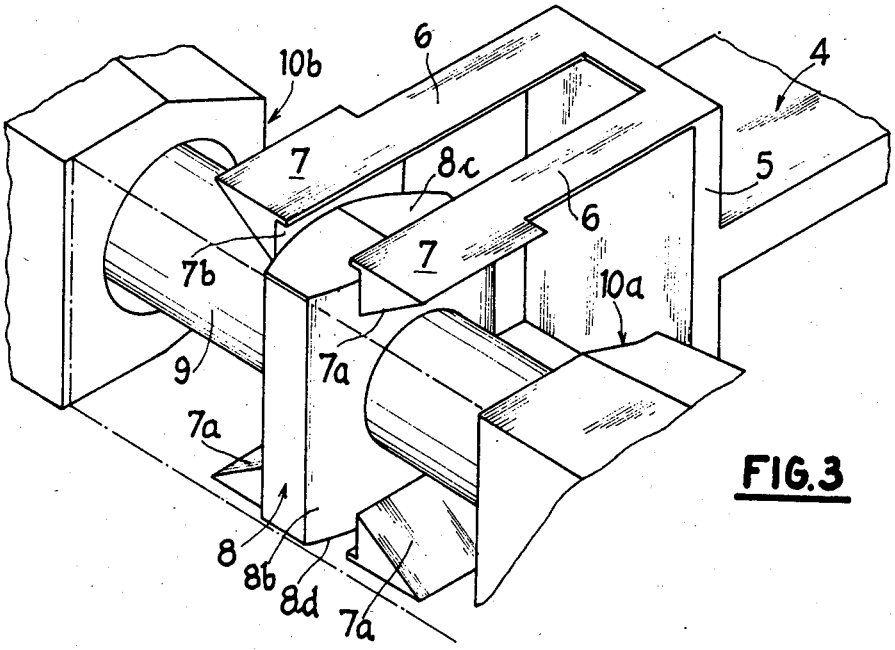
FIG.3

RELEASABLE COUPLING FOR ELECTRICAL VEHICLE-LATCH MECHANISM

The present invention relates to a device for engaging and releasing a coupling for use in particular in an electric mechanism for locking a latch for a motor vehicle door.

More precisely, this device is of the type comprising a driving element movably mounted on a support and a receiving element to which are attached coupling engaging and releasing means which may be driven by the driving element and the receiving element from a locking position to an unlocking position, and vice versa.

It is known that motor vehicle door latches must perform a number of functions which are: the retention of the door, the opening and closing of the door and the locking of tne opening function. All these functions are usually performed by a mechanical logic, but in certain constructions, the locking operation is electric for reasons of, in particular, comfort of utilization.

These electrically locked latches may be in two forms:

- either an electric actuator acting on the locking lever of the latch is added to an existing mechanical latch;
- or a specific latch is constructed in which the electric locking system is incorporated.

In either case, if a breakdown occurs in the electric supply system, each passenger must be in a position to unlock his door for leaving the vehicle and, if possible, the driver must be in a position to lock mechanically the latches of his vehicle and to unlock at least one door for the purpose of entering the vehicle. Thus, it will be understood that the electric system must not oppose a manual action of the locking system. One solution consists in providing a reversible electric system which is driven by the manual action and opposes a slight resistance to this action, but this condition limits the performances of the electric system which is thus liable to be unable to meet the specification imposed by the constructor of the vehicle.

Another solution consists in placing a coupling releasing system which uncouples the electric locking motor from the locking lever, so as to permit a manual action and couples these two elements as soon as there is an electric force exerted on the locking system.

According to the invention, the coupling engaging and releasing means comprise two resilient strips each provided with at least one wedge, said wedges being symmetrical relative to a plane of symmetry intersecting the axis of displacement of the driving means and extending through the latter, and each wedge has a planar surface parallel to said plane and facing toward the latter and an inclined ramp which is inclined with respect to the plane of symmetry and faces in the opposite direction to the latter, these strips being disposed in such manner as to be capable of engaging on the driving element by one of their planar surfaces parallel to the plane of symmetry so as to drive the receiving element from the locking position to the unlocking position, or vice versa, by resiliently moving away from the driving element so as to assume an uncoupled position in one of the two aforementioned locking and unlocking positions.

Preferably, the device is provided with two pairs of resiliently strips each provided with a wedge, the assembly of four wedges surrounding the driving element with which they can be coupled and from which they may be released at the end of travel. The strips are placed symmetrically on each side of the plane of rotation of the locking lever about its axis so as to distribute the forces correctly.

According to an embodiment of the invention, the driving element is a block disposed in the cage formed by the wedges fixed to the resilient strips, this block being driven in translation or in rotation by an electric actuating system. The movement of this block, which drives the locking lever by exerting a force on the wedges of the resilient strips, is limited by two end-of-travel abutments whose profile cooperates with the inclined ramps of the wedges which slide on these abutments, which causes the uncoupling which allows a subsequent manual operation of the locking lever.

Further features and advantages of the invention will be apparent from the following description with reference to the accompanying drawings which illustrate several non-limiting embodiments of the device according to the invention:

FIG. 1 is a perspective view of a first embodment of a latch provided with a coupling engaging and releasing device according to the invention;

Figure 2:
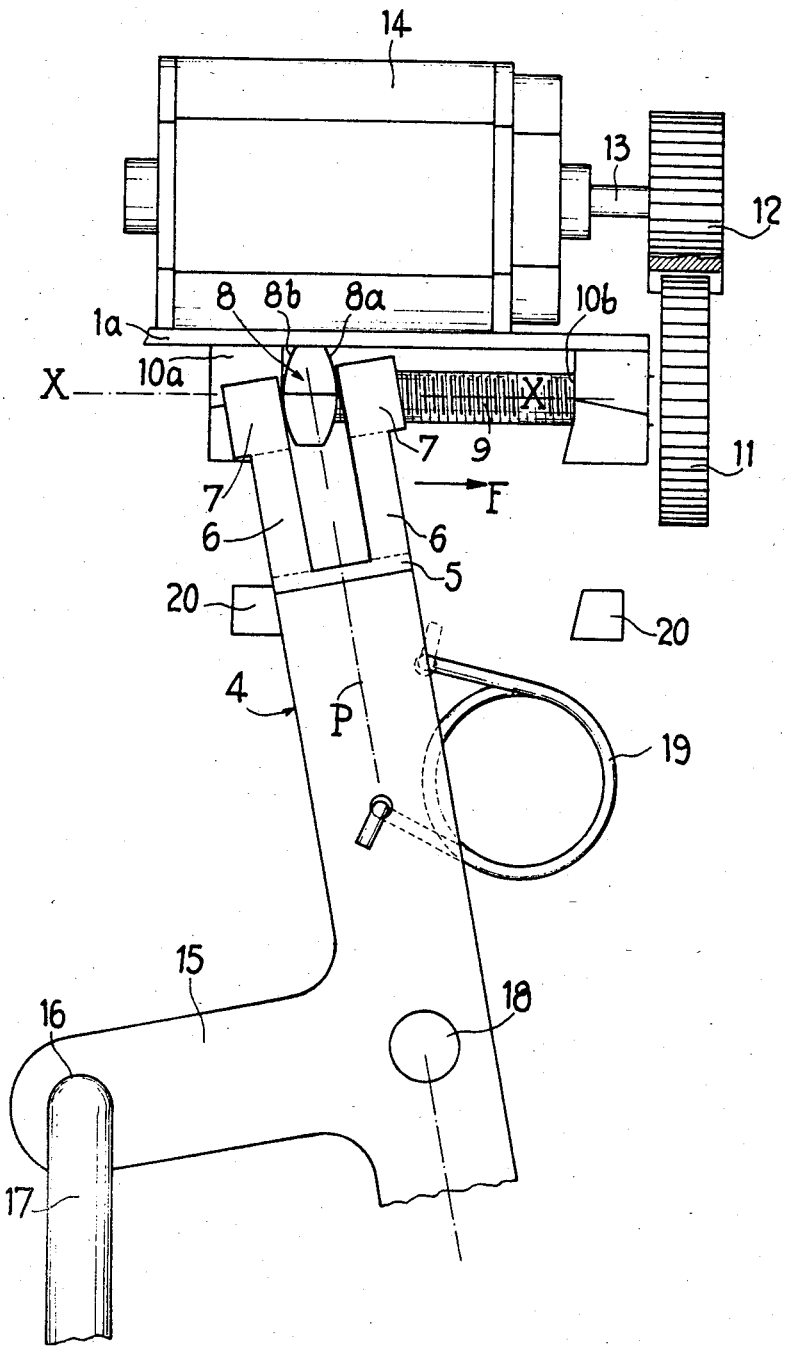
FIG. 2 is a partial plan view to an enlarged scale of the coupling engaging and releasing device shown in FIG. 1.
Figure 3A:
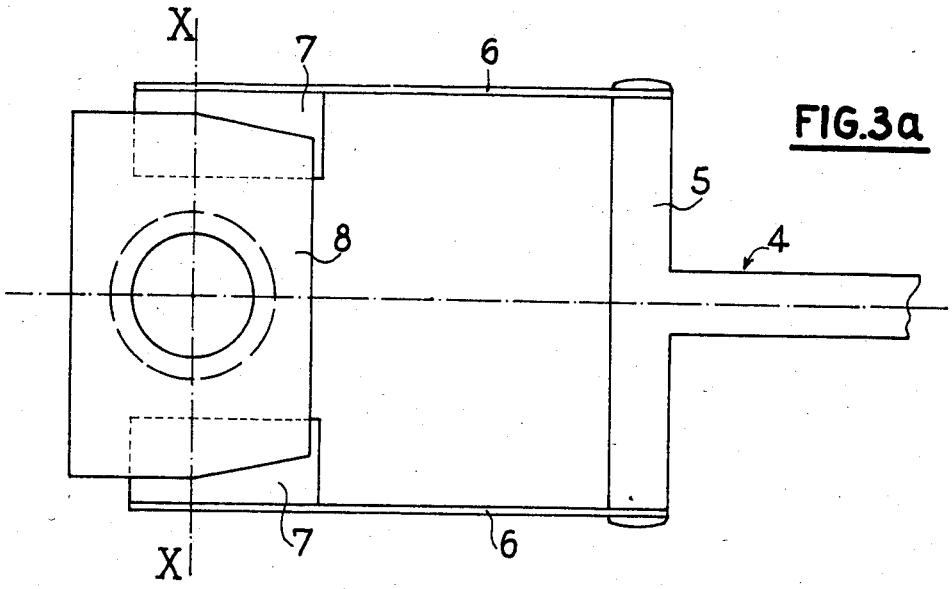
FIG. 3 is a partial perspective view to an enlarged scale of the resilient strips and the driving element of the coupling engaging and releasing device shown in FIG. 1, the driving element and the strips being shown substantially in their midway positions of travel.
Figure 3B:
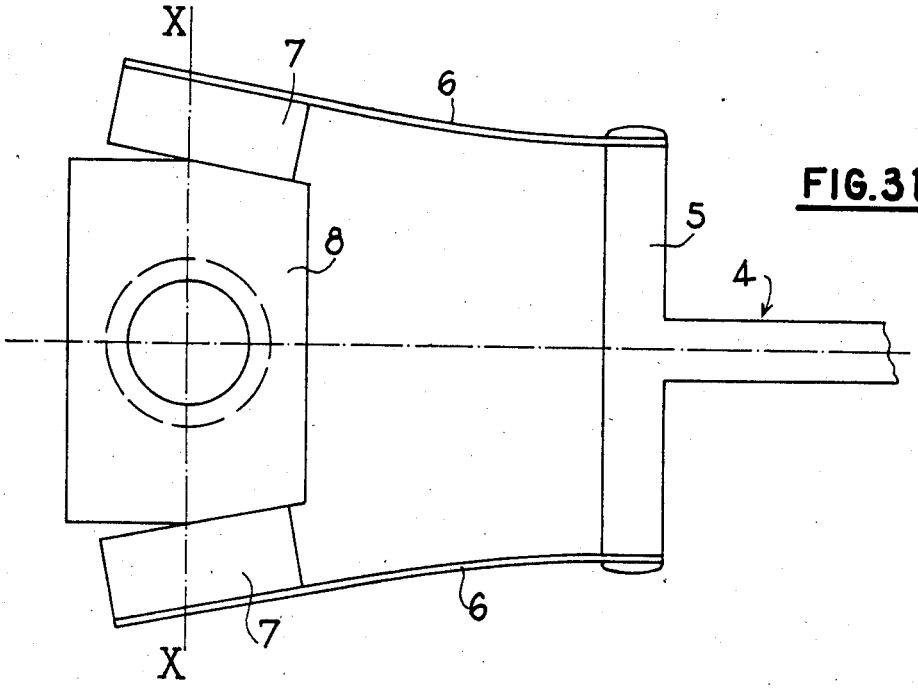
Figure 4:
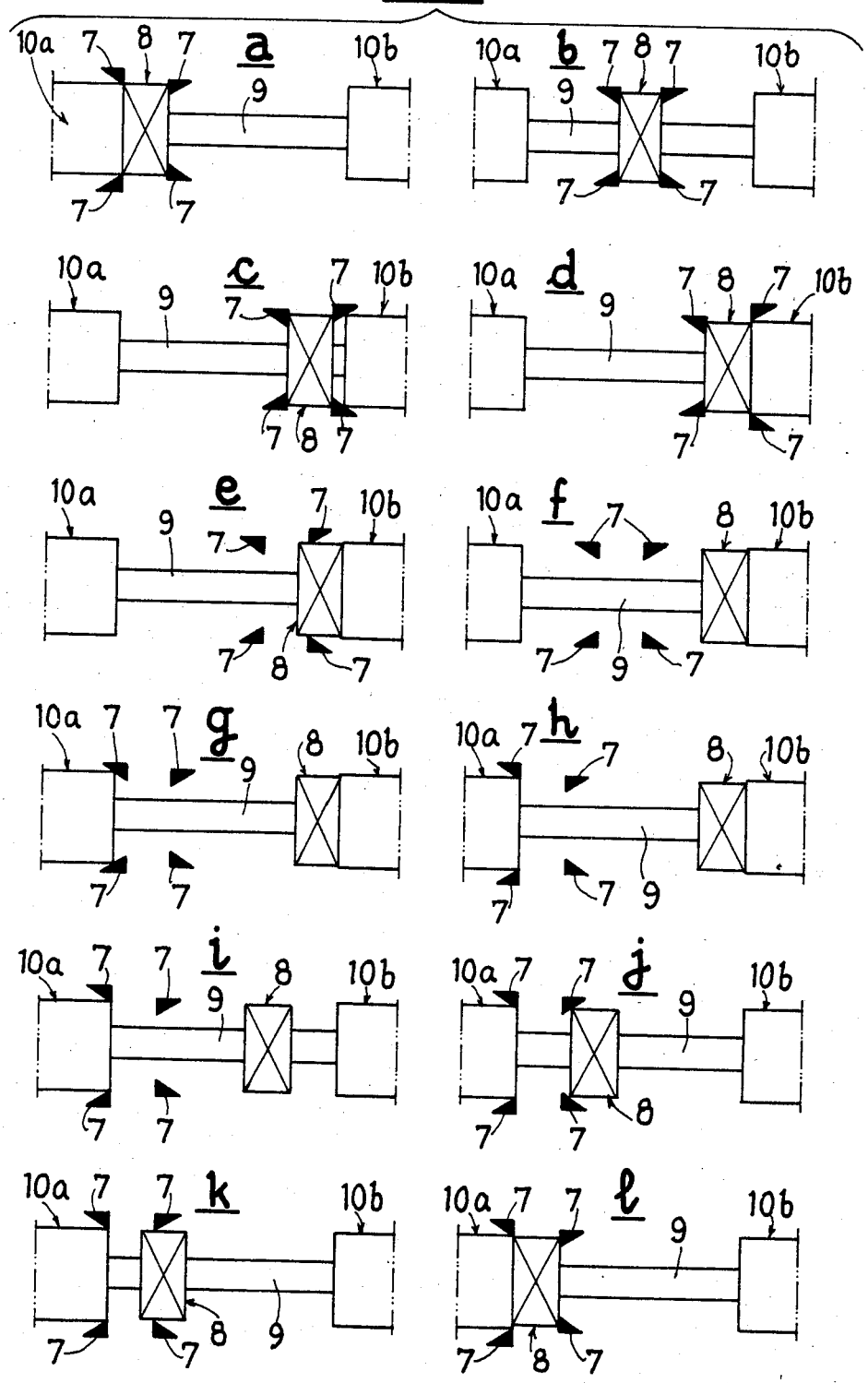
Figure 5:
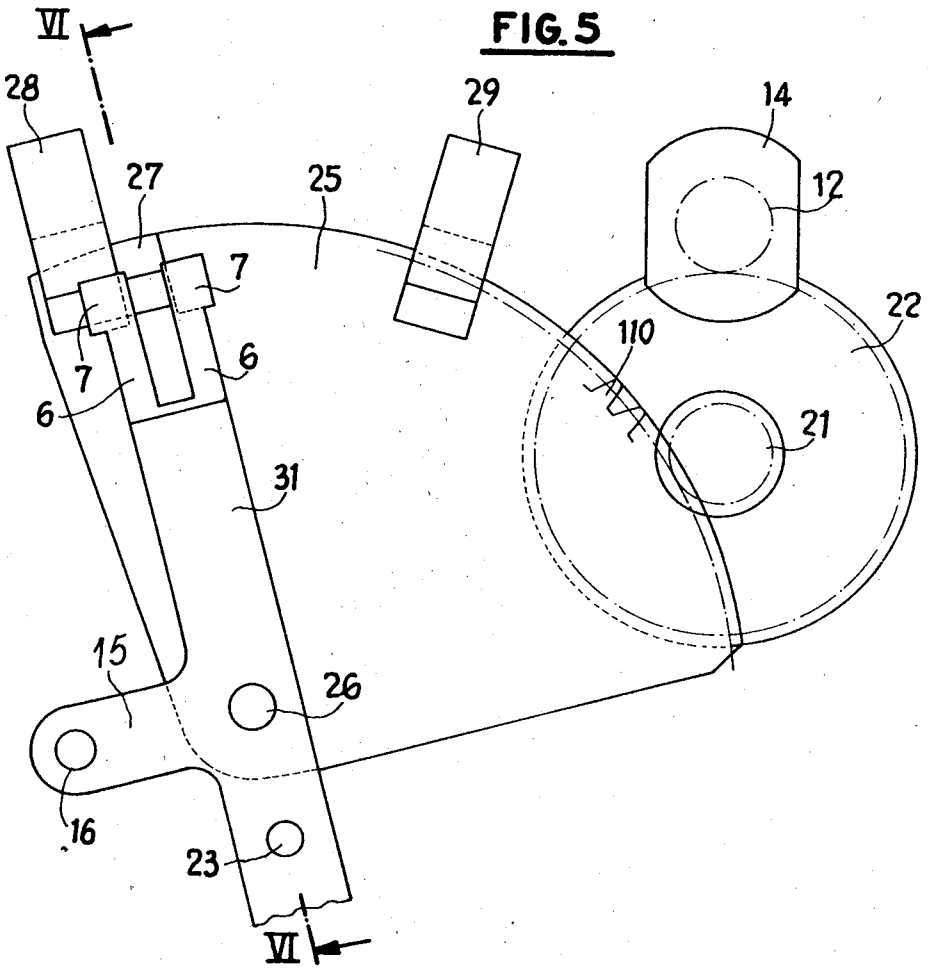
Figure 6:
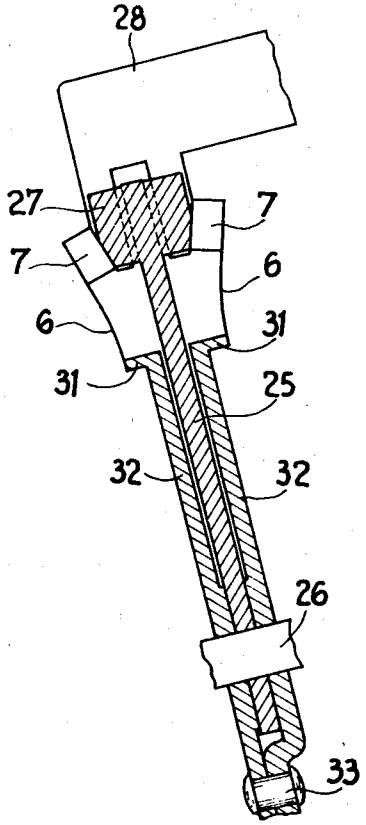
Figure 7:
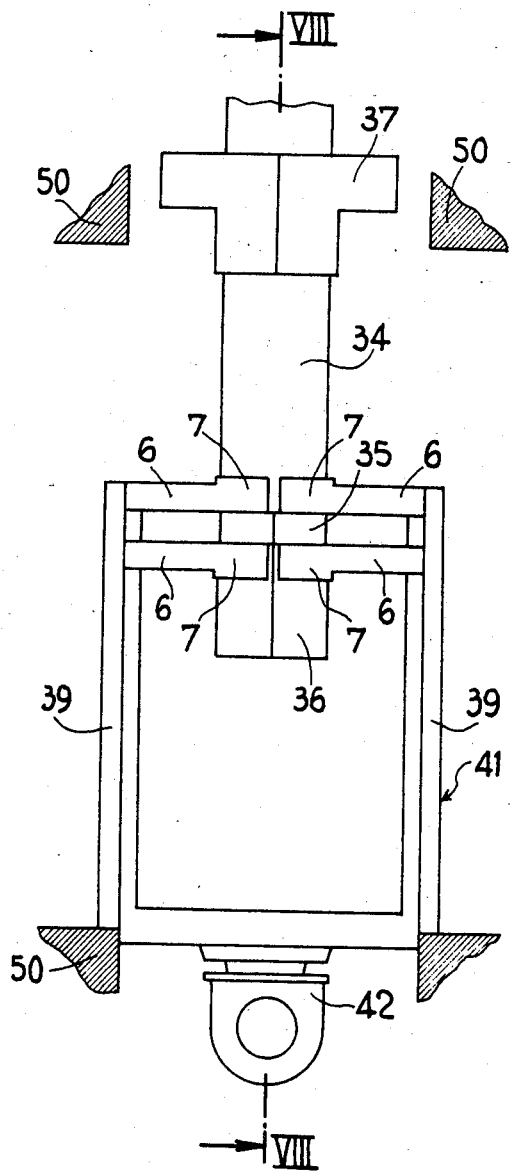
Figure 8:
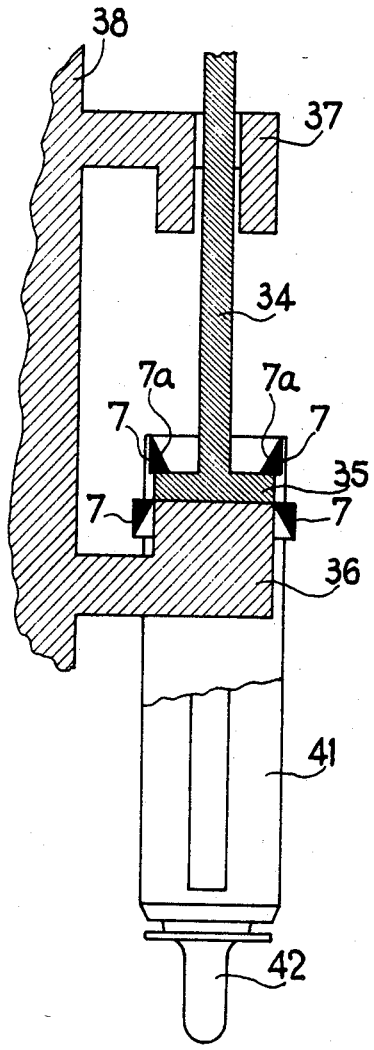
Figure 9:
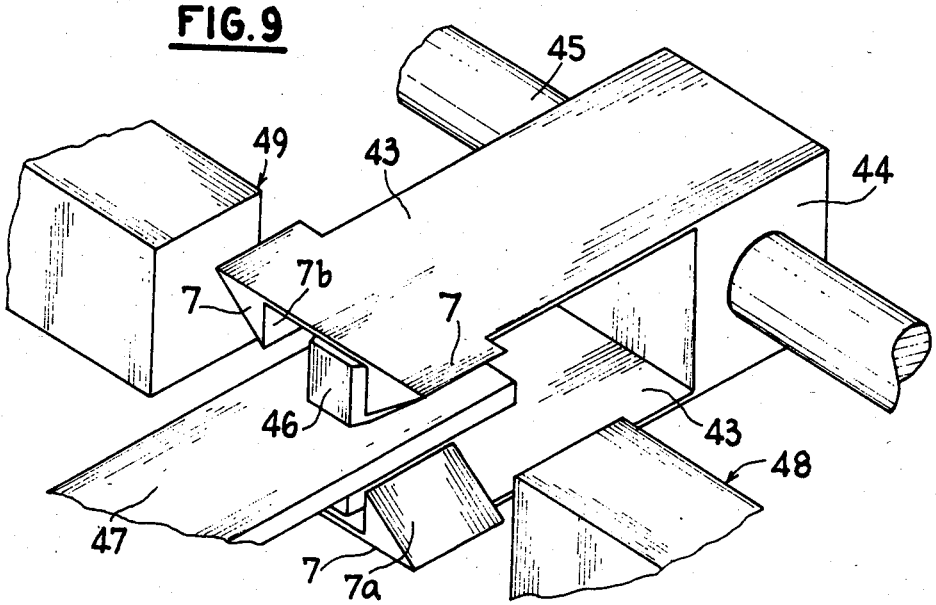
Figure 10:
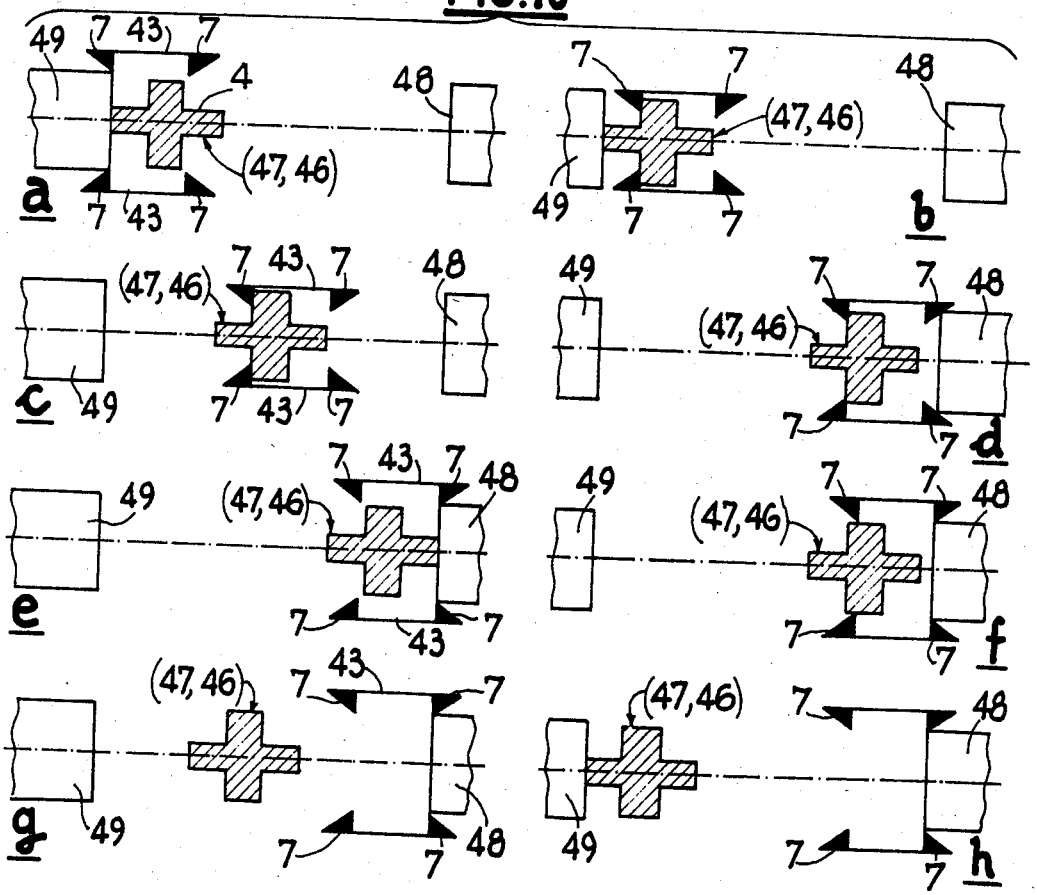

FIG. 3*a* is a side elevational view of the driving element and a pair of strips of the device shown in FIGS. 1 to 3, mounted on the locking lever in the coupled position, and FIG. 3*b* is a view similar to FIG. 3 showing the strips in the uncoupled position;

FIG. 4 is a group of diagrams illustrating the various sequences of operation of the coupling releasing device shown in FIGS. 1 to 3, namely first of all from the locking position to the unlocking position and then from this second position to the first position for locking with a mechanically controlled return of the driving element;

FIG. 5 is an elevational view of a second embodiment of the coupling engaging device according to the invention;

FIG. 6 is a cross-sectional view taken on line VI—VI of FIG. 5;

FIG. 7 is an elevational view of a third embodiment of a coupling device according to the invention;

FIG. 8 is an axial sectional view taken on line VIII—VIII of FIG. 7;

FIG. 9 is a partial perspective view of a fourth embodiment of the coupling device according to the invention;

FIG. 10 is a group of simplified diagrams illustrating a sequence of the operation of the device shown in FIG. 9, from the locking position to the unlocking position, with a mechanically controlled return of the driving element to the locking position, the resilient strips being left in the unlocking position by the electric control system.

FIG. 1 shows a latch 1 for a motor vehicle door, comprising a retaining mechanism (not shown), and a mechanical opening and locking logic (not shown). A keeper 2 fixed to the frame of the vehicle is capable of entering a cavity 3 formed in the latch 1 and cooperating with the retaining mechanism.

The latch 1 is provided with a coupling engaging and releasing device which includes a driving element 8 movably mounted on a support 9, and a receiving or driven element 4 to which are attached coupling engaging and releasing means which may be driven by the driving element 8 and the receiving element 4 from a locking position to an unlocking position, and vice versa.

According to the invention, the coupling engaging and releasing means comprise at least two resilient strips 6 which are four in number in the presently described embodiment, and which are each provided with at least one wedge 7. Each strip 6 in the presently described embodiment carries one wedge 7. The wedges are symmetrical relative to a plane of symmetry P (FIGS. 2, 3*a*, 3*b*) intersecting the axis X—X of movement of the driving element 8, and passing through the latter. Each wedge 7 has a planar surface 7*b* parallel to the plane P and facing toward the latter, and a ramp 7*a* which is inclined to the plane of symmetry P and faces away from the latter. The two pairs of strips 6 are fixed at the end of a lever 4 connected to the mechanical locking system through a support plate 5 perpendicular to the plane P and to the strips 6. Each wedge 7 is formed at the free end of a strip 6, the sub-assembly comprising the lever 4, the plate 5, the resilient strips 6, the wedges 7 being so arranged as to maintain the wedges 7 in correct position relative to the driving element 8. The assembly of the wedges and the strips 6 forms a cage in which the driving element 8 is disposed, this element being formed by a tapped block constituting a nut and mounted on a lead-screw 9 constituting the aforementioned support. The block 8 is prevented from rotating but is capable of being driven in translation along the lead-screw 9 by rotation of the latter, this lead-screw being rigid with a gear wheel 11 which is engaged with a gear pinion 12 rigidly secured to a shaft 13 of an electric motor 14. The direction of translation of the nut or block 8 is in the plane of rotation of the locking lever 4 which can be driven in rotation in this plane in either direction by two of the four strips 6 which are driven by the block 8 which is driven in translation by the rotation of the lead-screw 9. The movement in translation of the block 8 is limited by two end-of-travel abutments 1O*a*, 1O*b* respectively placed in a "locking" position and an "unlocking" position and which are capable of alternately cooperating with two of the four wedges 7, depending on the direction of movement of the block 8, namely with the two wedges placed on the same side of the block 8.

The locking lever 4 is pivotally mounted on a pin 18 (FIG. 2) connected to the body of the latch 1 and includes an extension portion 15. A rod 17 is connected in an aperture 16 in the extension portion 15 and is connected at its other end (not shown) to the mechanical locking means (window frame knob, key-actuated lock . . . ) disposed on the inside or outside of the door.

A wall 1*a* separates the motor 14 from the coupling releasing and engaging mechanism, the block 8 being slidable along this wall 1*a* which prevents the rotation of the block 8 about the axis X—X of the lead-screw 9. The lever 4 is movable between two positions which respectively correspond to the "locking" state represented in FIG. 2 and the "unlocking" state of the latch in which the block 8 is in contact with the abutment 10*b* adjacent to the pinion 11. These two positions of the lever 4 are defined by fixed abutments 20 rigid with the case of the latch 1, and the lever 4 may be maintained in either of these positions by a bistable spring 19 (FIG. 2).

The strips 6 are disposed in such manner as to be at rest in their position of coupling engagement with the driving element 8 (FIG. 3*a*), the planar surfaces 7*b* parallel to the plane of symmetry P being then applicable alternately against the driving block 8, depending on the direction of displacement of the latter on the lead-screw 9. On the other hand, in the released coupling position (FIG. 3*b*) reached when the block 8 is stopped by one of the abutments 1O*a*, 1O*b*, the inclined ramps 7*a* of the pair of strips 6 located between the block 8 and the concerned abutment 1O*a* or 1O*b* have slid along the upper edge of the abutment and are moved away from the block 8.

The operation of the coupling engaging and releasing device just described is as follows:

It must be first of all noted that many latches cannot be locked when the associated door is open so that it will be considered hereinafter that this door is closed. The mechanism preventing the locking when the door is open is included in the mechanical logic of the latch and will not be described here.

With the latch unlocked, or locked, an electric pulse is delivered to the case controlling the locking or unlocking, and this supplies power to the motor 14 in accordance with the suitable polarity. The motor 14 drives the lead-screw in rotation through the gear train 12, 11, so that the block or nut 8, which is guided by the ball 1*a*, moves from one end-of-travel abutment (10*a*, or 1O*b*), to the other. Let it be assumed that the initial position is that illustrated in FIG. 2, in which the block is in contact with the abutment 1O*a*. The block 8 will therefore move from the left to the right (arrow F, FIG. 2). From the start of this movement, the block 8, which has two opposed curved surfaces 8*a*, 8*b*, bears by its curved surface 8*a* (on the right as viewed in FIG. 2) on the surfaces 7*b* of the wedges 7 of the two strips 6 located on the right, i.e. "in front of" the block 8, relative to its direction of displacement, the strips 6 concerned being in the position of rest as illustrated in FIG. 3*a*. On the other hand, the two opposite strips 6, i.e. those located on the left, as viewed in FIG. 2, are released from the block 8 so long as the latter has not started its movement toward the right, the inclined ramps 7*a* of these strips 6 having indeed slid along the upper edge of the abutment 10*a* and thus moved away from the block 8 (FIG. 3*b*).

In its movement, the block 8 urges the strips 6 on the right by the surfaces 7*b* of the latter and therefore drives in rotation the lever 4 and the four strips 6 in the clockwise direction (FIG. 2). During the approach of the end-of-travel abutment 10*b*, the ramps 7*a* of the wedges urged along by the block 8 come into contact with the edges of the abutment 10*b* so that a part of the thrust exerted by the block 8 and applied against the ends of the two strips 6 located between the block 8 and the abutment 10*b*, spreads apart these two strips (FIG. 3*b*). As the clearance between the abutment 10*b* and the block 8 decreases, the distance between the two strips 6 on the right increases until the block 8 stops against the abutment 10*b*, the strips 6 against which the block exerted a thrust being completely spread apart. The bistable spring 10 applies the lever 4 against the abutment 20 on the right in FIG. 2.

The strips 6 are so arranged as to have great stiffness in the plane of rotation of the lever 4 so as to be capable of transmitting great forces, and a good flexibility in the plane perpendicular to the axis X—X of the lead-screw 9. The force required to spread apart these strips therefore remains small and the stresses they are subjected to in the position shown in FIG. 3*b* are low.

There will now be examined the sequences of operation of the coupling engaging device which has just been described, with reference to the diagrams shown in FIG. 4.

It will be assumed first of all that the "left" position of the strips 6 and the lever 4, in which the block 8 is stopped by the abutment 1O*a* on the left, corresponds to the "locking" position on the latch 1, and that the "right" position, in which the block 8 is stopped by the abutment 10*b*, corresponds to the "unlocking" position on the latch. The choice of this correspondence between "left-right" and "locked-unlocked" is of course arbitrary and has no effect on the operation of the latch.

With the device in the position a of FIG. 4, the block 8 is in contact with the abutment 1O*a*, the two wedges 7 of the left strips 6 are released from the block 8 and separated from each other on each side of the abutment 1O*a*, while the other two wedges 7 are in their engaged or coupled position of rest. An unlocking command is sent to the control box. The motor 14 is supplied with power and the block 8 moves toward the "unlocking" position along the lead-screw 9 and urges apart the two wedges 7 which are located in front of the block and with which it is coupled. The assembly moves toward the unlocked position (the expressions "unlocked" and "unlocking" being employed indifferently hereinafter, the same being true of "locked" and "locking").

When they reach the vicinity of the right abutment 1O*b*, the two right wedges 7 come into contact with the edges formed by the vertical and upper surfaces of the abutment 1O*b* and start to spread apart the corresponding strips 6 (position c). The movement is completed when the block 8 abuts against the abutment 1O*b*, the right strips 6 being completely spread apart (position d). The locking lever 4 is maintained in the unlocking position against the right abutment 20 by the spring 19.

If in this position the user decides to lock his door mechanically (for example owing to a breakdown of the electric supply circuit), he acts through a control (not shown, for example a window surround knob inside the door, a lock on the outside of the door) on the rod 17 which, as it is connected to the lever 4 through the extension portion 15, drives the lever 4. As the two right strips 6 are in the spread-apart position, the wedges 7 fixed to the latter can freely slide along the opposite surfaces 8*c*, 8*d* of the block 8 (position e in FIG. 4). Then the lever 4, in passing beyond the block 8, continues its locking movement (position f). At the end of the movement, the wedges 7 of the two left strips 6 come into contact with the edges of the left abutment 1O*a*, and start to move apart the corresponding strips 6 (position g). The movement is finished when the lever 4 abuts against the left abutment 20, the two left strips 6 being completely spread apart (position h). The latch is mechanically locked, i.e. the latch opening control is locked, although the electric locking system has remained in the "unlocking" position.

In such a position, the abutment 20 for the lever 4 is such that the gap between the surface of the abutment 1O*a*, and the surfaces 7*b* the wedges 7 carried by the strips 6 at rest, and facing this abutment, is at least equal to the width of the block 8.

Beyond this position, in which the electric and mechanical systems no longer coincide, a new electric command which may be given must shift the block 8 toward the locking position (stage i of FIG. 4). A little before reaching the position of abutment, the block 8 comes, by the edges defined by its upper and lower surfaces 8*c*, 8*d*, into contact with the inclined ramps 7*a* of the two right strips 6. Owing to the wedging effect, a radial force spreads apart these strips 6 (step j). When the strips are fully spread apart, the block 8 continues its moVement and the wedges 7 slide along the surfaces 8*c*, 8*d* of the block 8 (step k).

Just before arriving in the position against the abutment 1O*a*, the rear surface 8*a* of the block 8 passes beyond the plane in which the surfaces 7*b* of the two right strips 6 are located so that they may then freely return to their coupled position of rest (final step l. The block 8 then stops against the abutment 1O*a* and the system is in the same position as the initial position.

The second embodiment of the coupling engaging and releasing device illustrated in FIGS. 5 and 6 permits an elimination of the movement of translation of the preceding arrangement. Indeed, the use of the coupling for converting a movement of translation into a movement of rotation presents certain problems in respect of the choice of the shapes.

In the arrangement shown in FIGS. 5 and 6, the motor 14 drives, through a speed reducing gear train 12, 22, 21, a toothed sector 110 mounted on a plate 25 which is pivotally mounted on a pin 26 and carries a block 27 on its circumference. This block is movable during the rotation of the plate 25 between two end-of-traval abutments 28, 29 and carries along therewith by means of the wedges 7 resilient strips 6 which are fixed on brackets 31 each of which is connected to a lever 32. The two levers 32 constitute a locking lever and are mounted on opposite sides of the plate 25 and pivotable on the pin 26 and interconnected by a second pin 33. The strips 6 which cooperate with the block 27 are four in number, as in the embodiment shown in FIGS. 1 to 3, and their wedges 7 are arranged in a similar manner.

This device operates in the same way as the device shown in FIGS. 1 to 3, except that the block 8 moves in rotation and not in translation.

In the third embodiment of the invention, illustrated in FIGS. 7 and 8, a bar 34 carrying a block 35 is movable in translation between two abutments 36, 37 connected to a fixed frame 38. The block 35 is capable of shifting, through surfaces 7*b* of wedges 7, the resilient strips 6 which are eight in number and mounted on at least one arm 39 of a carriage 41, the latter being guided to move in translation by the frame 38 by means of devices not shown. The carriage 41 includes a ring 42 to which is connected the locking device with its manual controls.

As in the preceding embodiments, the block 35 and the abutments 36, 37 have shapes so defined as to permit the spreading apart of the strips 6 under the action of the ramps 7*a* of the wedges 7, when the block 35 arrives in a position against an abutment 36 or 37, or when, after a manual operation of the locking system, the block 35 is electrically returned to the region of wedges 7.

This embodiment operates in a similar way to the preceding embodiments.

In the modification shown in FIG. 9, the coupling engaging and releasing device comprises two resilient strips 43 each carrying a pair of wedges 7 similar to the wedges 7 of the preceding embodiments, but the two strips 43 are fixed to a block 44 having a tapped bore through which a lead-screw 45 extends. The four wedges 7 constitute a cage in which is located a projecting member 46 rigid with a locking lever 47, the four wedges 7 and the member 46 being placed between two end-of-travel abutments 48, 49.

In its movement of translation along the lead-screw 45, the block 44 drives the lever 4 in rotation through the surfaces 7*b* of the wedges 7 placed on the same side of the member 46. When the assembly 47, 46, 7, 43, 44 approaches an end-of-travel abutment 48 or 49, the wedges 7 bear by their ramps 7*a* against the upper and lower edges of the abutment in question, and are spread apart and thereby release the coupling with the member 46. Just before the lever 47 arrives in its position of abutment, the strips 43 are completely uncoupled and the lever is driven against the abutment 48 or 49 by the bistable spring 19.

The device is then in the position diagrammatically represented in FIG. 10*a*. As a result of an electric pulse, the block 44 and the strips 43 and wedges 7 move to the right. The left wedges 7 slide on the left abutment 49 and move toward each other, and completely resume their position of rest when their surfaces 7*b* come into contact with the projecting member 46 and consequently drive the lever 47 toward the opposite abutment 48 (stage b in FIG. 10). The assembly then moves to the right (stage c) until the right wedges 7 come in contact with the end-of-travel abutment 48 (stage d). The two strips 43 and the four wedges 7 are then again spread apart and the assembly is completely uncoupled just before the lever 47 reaches its position of abutment, the remainder of its travel being ensured by its bistable return spring 19 (stages d and e).

If in this position the locking lever 47 is acted upon manually, this lever can freely travel from the right toward the left, the distance between the wedges 7 being indeed greater than the height of the projecting member 46 (stage f). The lever 47 continues its travel toward the end-of-travel abutment 49 on the left (stages d and h). If it is then desired to return the strips 43 to the region of the lever 47, these will be spread apart owing to the left wedges 7 so as to travel beyond the position of the projecting member 46 and assume the position shown in FIG. 10*a*.

It will be understood that, irrespective of the embodiment employed, a manual action is always possible whether the two elements constituting the coupling occupy identical or different stable position, without driving the electric motor. The driving system can therefore be irreversible.

What is claimed is:

1. A coupling engaging and releasing device, in particular for an electric locking mechanism of a latch for a motor vehicle door, said device comprising a support, a driving element mounted on the support to be movable along an axis, a receiving element, coupling engaging and releasing means which are attached to the receiving element and are capable of being driven by the driving element and the receiving element from a locking position to an unlocking position and vice-versa, the coupling engaging and releasing means comprising at least two resilient strips, at least one wedge carried on each of said strips, said wedges being symmetrical relative to a plane of symmetry which intersects said axis of movement of the driving element and passes through the driving element and each wedge having a planar surface which is parallel to said plane and faces toward said plane, and a ramp which is inclined to said plane and faces away from said plane, said strips being disposed in such manner as to be capable of being coupled to the driving element by one of said planar surfaces which are parallel to said plane of symmetry so as to drive the receiving element from said locking position to said unlocking position and vice-versa, by resiliently moving away from the driving element so as to assume an uncoupled position in one of said locking and unlocking positions.

2. A device according to claim 1, comprising end-of-travel abutments for the driving element respectively in the locking position and unlocking position of the driving element.

3. A device according to claim 1, wherein the resilient strips are so disposed as to be in their coupling engaging position at rest, the planar surfaces of the wedges parallel to said plane of symmetry being then capable of being alternately applied against the driving element interposed between the wedges.

4. A device according to claim 1, comprising two sets of two resilient strips fixed to said receiving element, each strip carrying a wedge, said wedges being disposed symmetrically relative to the driving element.

5. A device according to claim 4, wherein the receiving element comprises a locking lever mounted to be rotatable about a first pin and including a projecting portion which is cooperable with a connecting member of manual means for shifting the lever.

6. A device according to claim 5, wherein the locking lever is movable between two positions respectively corresponding to the locking state and unlocking state of the latch defined by fixed abutments connected to a case of the latch, and a bistable spring combined with said lever for maintaining said lever in either of said positions thereof.

7. A device according to claim 4, wherein the driving element comprises a nut mounted on a lead-screw and two end-of-travel abutments are cooperable with said nut to define said ends of travel, said abutments having lateral surfaces which are cooperable with the ramps of the wedges mounted on the strips so as to spread apart said strips and ensure the released position of the coupling when the locking lever is in either of its stable positions, said nut being moreover guided in rotation by a wall connected to a case of the latch and on which wall the nut slides during the movement of the nut.

8. A device according to claim 7, comprising a gear wheel fixed on an end of the leadscrew, a driving motor having an output gear pinion which is engaged with said gear wheel for driving said lead-screw in rotation, said lead-screw being held against movement in translation.

9. A device according to claim 5, wherein the driving element is a block connected to a plate which is mounted to rotate about the pivot pin of the locking lever and movable between two end-of-travel abutments having surfaces which are cooperable with the ramps of the wedges so as to ensure the released coupling position when the locking lever is in either of its stable positions.

10. A device according to claim 9, wherein said locking lever comprises two arms disposed symmetrically relative to said plate and a second pin interconnecting said two arms.

11. A device according to claim 10, wherein said plate carries a toothed sector and the device further comprises a motor having an output gear pinion, and a gear train connecting said output gear pinion to said toothed sector.

12. A device according to claim 4, wherein the receiving element comprises a carriage which is guided to move in translation in a case of the latch and has an extension portion, the device further comprising means connecting the extension portion to said locking means, two end-of-travel abutments for limiting the movement in translation of the carriage between two positions, and means for resiliently maintaining the carriage in either of said positions.

13. A device according to claim 12, wherein said means for retaining the carriage in either of said positions is a bistable spring.

14. A device according to claim 12, wherein the driving element comprises a block connected to an arm which is driven in translation, said block being movable between two end-of-travel abutments having surfaces which are cooperable with the surfaces of the wedges of the strips so as to ensure the released coupling position when said block is in abutment against either of the end-of-travel abutments, and the carriage is movable between two abutments defining the locking and unlocking positions of the latch and a bistable spring is provided for maintaining the carriage in either of said positions.

15. A device according to claim 1, wherein the resilient strips are fixed to the driving element, each of said strips being provided with two wedges.

16. A device according to claim 15, wherein the driving element comprises a block fixed to a plate which is mounted to be rotatable about a pin and is provided with a toothed sector, a motor and transmission means being drivingly connected to said plate, the driving element being movable between two end-of-travel abutments having surfaces which are cooperable with the surfaces of the wedges so as to ensure the released coupling position when the block is in abutment against one of the two end-of-travel abutments.

17. A device according to claim 15, wherein the driving element comprises a block which is capable of driving resilient strips connected to at least one arm of a carriage which is guided to be movable in translation by a fixed frame to which two abutments are fixed, said block being movable in translation between said two abutments.

18. A device according to claim 1, comprising means for a manual actuation of said receiving element without driving the electric control means, irrespective of the relative stable positions occupied by said driving element and said receiving element.

* * * * *